United States Patent [19]

Warehime

[11] 4,344,628

[45] Aug. 17, 1982

[54] TURNSTILE GOAL AND GAMES USAGE

[76] Inventor: Norwood R. Warehime, 704 W. 34th St., Baltimore, Md. 21211

[21] Appl. No.: 202,188

[22] Filed: Oct. 30, 1980

[51] Int. Cl.[3] ..... A63B 63/06

[52] U.S. Cl. ..... 273/388; 273/127 R; 273/411

[58] Field of Search ..... 273/127 R, 127 D, 386, 273/387, 389, 411, 388

[56] References Cited

U.S. PATENT DOCUMENTS

| | | | |
|---|---|---|---|
| 443,427 | 12/1890 | Brown | 273/390 |
| 2,580,799 | 1/1952 | Lauterbach | 273/411 X |
| 3,756,599 | 9/1973 | Imatt et al. | 273/387 |

FOREIGN PATENT DOCUMENTS

| | | | |
|---|---|---|---|
| 641438 | 5/1962 | Canada | 273/127 R |
| 758413 | 11/1933 | France | 273/387 |
| 1367 | of 1880 | United Kingdom | 273/29 BB |
| 17343 | of 1903 | United Kingdom | 273/388 |

*Primary Examiner*—Anton O. Oechsle

[57] ABSTRACT

The invention provides a rugged, practical, and readily portable turnstile goal, having two to five relatively large sized paddle type elements of grided construction, a simple, rugged, and concealed turnstile rotary friction control system, and a simple, reliable, and highly visible turnstile fractional rotation indicating system. Subject turnstile goal is suitable for use in continuous and vigorous team action games such as football (soccer), team handball, lacrosse, and ice hockey, with only one goal and ball or disc needed, and with team players free to move above the entire playing area. Game set-up places turnstile goal in center of limit circle having radius of 3 to 5 mts (3 to 5 yds). Competing teams can number from four to ten players each, with game play comparable to that of conventional game, except that shot at goal must be from outside limit circle. No defense is permitted in circle. Players try to hit their respective sides of turnstile paddles with maximum impact of ball or disc to register maximum turnstile rotation. Team with more rotation in their direction at end of game is winner.

5 Claims, 4 Drawing Figures

FIG. 1
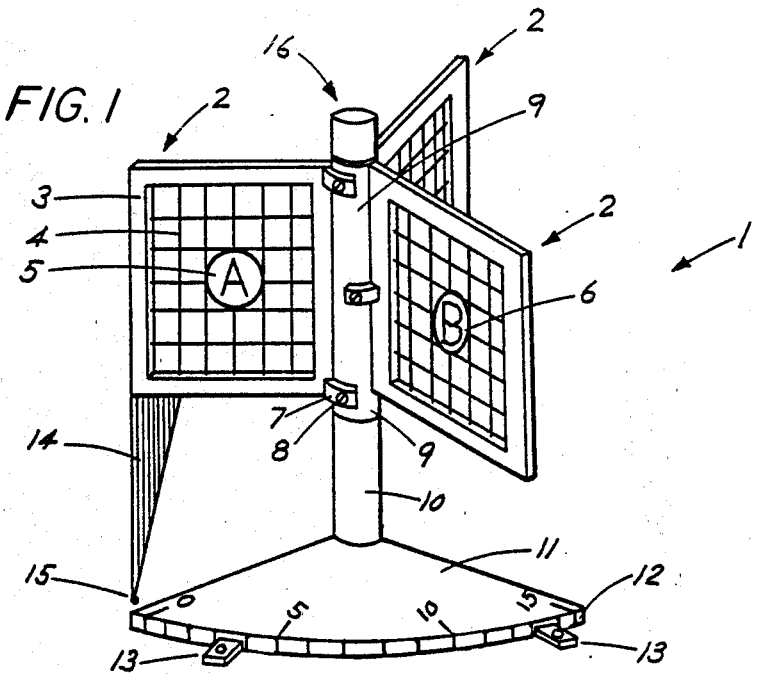
FIG. 2
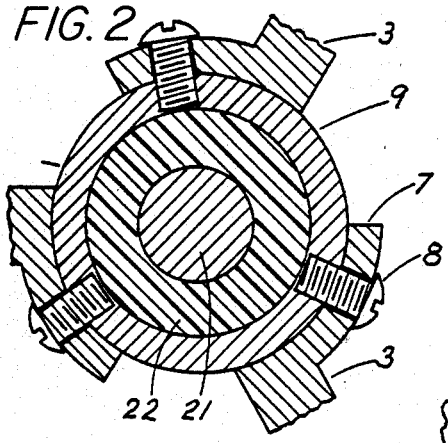
FIG. 3
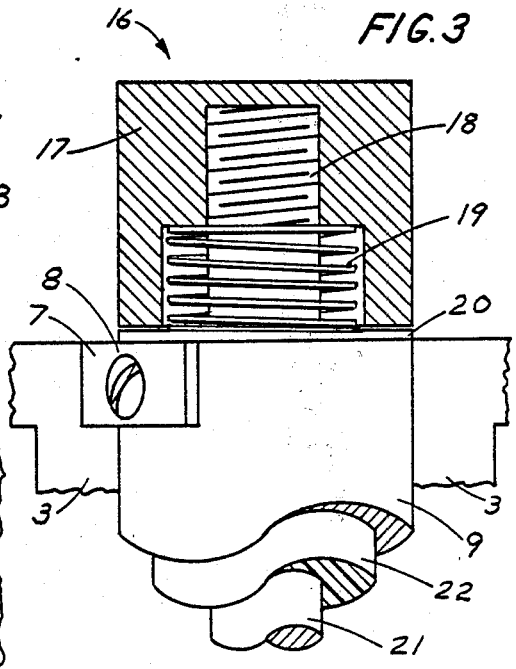
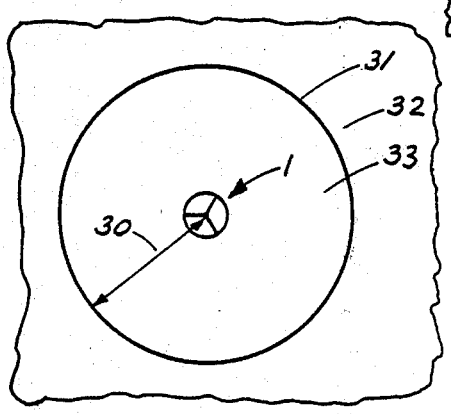
FIG. 4

TURNSTILE GOAL AND GAMES USAGE

DESCRIPTION

1. Technical Field

The invention relates to improved turnstile goal and games usage; a rugged turnstile with two to five substantially large sized paddle type elements, with appropriate support sleeve, spindle, column, and base is used as a goal disposed in center of a limit circle in various types of game play.

2. Background Art

Turnstile type goals in competitive games offer the following advantages as compared to conventional type goals: (a) reduces size of playing area required; (b) reduces number of goals required from two to one; (c) reduces size and cost of goal; (d) permits broader use of portable type goals; and (e) permits better use of a smaller number of players per team as compared to most comparable conventional games.

U.S. Pat. No. 443,427 discloses a relatively small sized centrally disposed turnstile type rotative disc target, which, when struck by a ball thrown by a player from outside a limit circle, is free to rotate and indicate certain number scores marked around said limit circle. U.S. Pat. No. 2,580,799 discloses a relatively large sized centrally disposed turnstile type rotative disc plate goal with a target hole in center of said plate, whereby competing players attempt to throw a play ball through said target hole from outside a limit circle surrounding said goal for point score. French Pat. No. 758,413 discloses a relatively small and fragile appearing portable turnstile type goal with four target discs which are to be struck by a small rubber ball propelled by a racquet in game play. Movement of target discs and turnstile can be registered on an indicating wheel geared to rotative central support spindle of turnstile. British Pat. No. 17,343 discloses weather vane type apparatus with relatively small balls, discs, or other devices attached to arms thereof, adapted to rotate in opposite directions on impact by balls, discs, or other objects rolled, thrown, or propelled by players. Movement of vane arms can be registered by certain signals or on indicator wheel geared to rotative central support spindle of apparatus. Certain compartment forming and protective screens are used in some game set-up variations. In general game play of cited patent, each of two teams is provided with one or more balls, and play is confined to specific screened compartments for each team. Players attempt to strike their respective vane targets for game play advantage. Game play limit lines are employed in some game set-up variations. Another game play variation employs a number of pendulum suspended balls which are projected at vane targets.

Neither of above cited U.S. patents uses paddle type elements in turnstile design to register relative impact force and frequency values in game play. Cited French patent using relatively small and fragile tunrstile elements, does register relative impact force and frequency values in game play, but details as to game play in team competition comparable to subject invention are lacking. The turnstile shown in drawings of French patent would not be suitable for vigorous team game play using relatively large balls such as footballs (soccer balls) or team handballs, or relatively heavy lacrosse balls or ice hockey discs (pucks) because of small size and fragile nature of turnstile design. Cited British patent approaches subject invention in some features but is not designed for vigorous team action game play employing a single ball or disc shared by both teams that are free to move about in the entire game playing area. Furthermore, target balls and discs attached to vane arms in latter cited patent are relatively small in size as compared to subject invention, and have no specific type of distinguishing markings or designations indicating which side of target device respective teams should attempt to strike, thus the design does not lend itself well for use in vigorous team action game play.

DISCLOSURE OF INVENTION

The invention as claimed is intended to provide a rugged, practical, and readily portable turnstile type goal, having relatively large sized paddle type elements, a simple turnstile rotary friction control means, and a simple turnstile fractional rotation indicating means, with said turnstile goal being suitable for use in various types of continuous and vigorous team action game play using only one game ball or disc, and with team players free to move about in the entire game playing area. The invention solves the problem of how to design: (a) simple and rugged large sized turnstile paddle elements that can readily be employed in goal assembly; (b) a simple, rugged, and concealed turnstile rotary friction control assembly; (c) a simple, reliable, and highly visible turnstile fractional rotation indicating system; and (d) instructions and rules for a variety of team action games using a turnstile goal, such games being comparable to conventional games of football (soccer), team handball, lacrosse, and ice hockey.

The advantages offered by the paddle type elements of the turnstile goal of the invention are mainly that they are identical in construction, are easy to use in turnstile goal assembly, are lightweight for their relatively large size, have minimum wind disturbance and obstructed visual field effects, and are readily identified on each side to show competing game players their respective goals at a considerable distance. Further advantages offered by subject turnstile goal in general are: (a) turnstile friction rotary control assembly is simple, rugged, concealed, protected from weather, unauthorized tampering and impact of stray balls or discs, and allows adjustment of turnstile ease of rotation to suit specific game or player types; (b) turnstile rotary fractional indicating system is simple, reliable, and highly visible, giving both players and spectators a chance to see effect of ball or disc impact on turnstile goal; (c) turnstile goal in knock-down form can be packaged and transported easily, and can be assembled into a turnstile goal in a few minutes, with assembled goal also being fairly easy to transport; (d) use of turnstile goals in game play can reduce size of playing area and number and cost of goals normally required for comparable conventional game play.

BRIEF DESCRIPTION OF DRAWINGS

The invention is described in detail with reference to drawings which illustrate one specific embodiment, in which:

FIG. 1 is a generalized perspective view of a turnstile goal in accordance with the invention, showing general assembly of components, featuring large size paddle type elements with team distinguishing markings and turnstile fractional rotation indicating system employing a pointer flag on one paddle element and a numbered scale on the support base perimeter;

FIG. 2 is an enlarged transverse partial section cut view of the vertical turnstile paddle support sleeve and spindle, showing typical paddle attachment to sleeve;

FIG. 3 is an enlarged partial detail view of upper end of vertical turnstile paddle support sleeve and spindle, with a longitudinal section cut view of spindle cap nut revealing compressed turnstile friction control spring; and FIG. 4 is a plan view of a typical game play set-up showing placement of turnstile goal in center of a limit circle on playing surface.

DESCRIPTION AND PREFERRED EMBODIMENT FOR CARRYING OUT INVENTION

FIG. 1 shows a preferred embodiment of invention in which turnstile goal is generally indicated by numeral 1, and three rectangular grid paddle elements are generally indicated by numeral 2. Each of the paddle elements 2 comprises a rectangular metal frame 3, wire or rod elements 4, team goal designation markings 5 and 6 for teams "A" and "B" respectively, and frame mounting lugs 7. Each of the paddle elements 2 actually has back-to-back goal designation markings 5 and 6 for teams "A" and "B", but drawing demonstrates general design by using two separate paddle elements. Markings should be interchangeable and in bright colors for ease of observation and recognition. Paddle elements 2 are mounted on rotative support sleeve pipe 9 by fastening screws 8 passed through mounting lugs 7 at three places per paddle element frame edge and set in vertical planes at 120° spacing around support sleeve pipe 9. FIG. 2 shows detail of method for mounting paddle element frames 3 on support sleeve pipe 9. Also shown in FIG. 2, as well as in FIG. 3, is elongated plastic bushing 22 placed between outer support sleeve pipe 9 and central metal spindle rod 21, the latter holding the upper portion of the turnstile and allowing it to be able to rotate freely. Spindle rod 21 is united at its lower end to support pipe section 10, with juncture formed so as to provide a smooth concentric bearing surface around spindle rod 21 in the horizontal plane where pipe sections 9 and 10 butt, as shown externally in FIG. 1. Said bearing surface at said juncture carries weight of upper portion of the turnstile, thus allowing it to be able to rotate about spindle rod 21. Lower end of support pipe 10 is attached to center of weighted conic section base support 11 which has scale markings and numbers 12 around its perimeter. Anchor lugs 13 are also disposed around perimeter of base 11 for securing it to playing surface with anchor pins if appropriate. A flag type pointer 14, with weighted tip 15, is attached to outer lower side of one of the paddle elements 2 for use in conjunction with scale markings and numbers 12 to serve as a turnstile fractional rotation indicator. FIGS. 1 and 3 show spindle cap nut assembly generally indicated by numeral 16 at top of turnstile goal 1. The elevational section view in FIG. 3 of actual cap nut 17 reveals threads 18 on upper end of spindle rod 21, compressed friction control spring 19, and wear washer 20. Friction force exerted by spring 19 between fixed cap nut 17 and rotative support pipe 9 can be controlled by making changes of springs with varying stiffness and insertion of small washers placed on spindle rod 21 above or below spring. Spring compression could also be varied by using a more elaborate cap nut assembly with locking arrangement which would permit varied positioning of cap nut. FIG. 4 is a plan view of typical game play set-up showing placement of turnstile goal 1 in center of limit circle 31 marked on playing surface, with radius indicated by 30. Valid playing and goal shooting area outside of limit circle is indicated by 32, and non-shooting and non-defensing area within limit circle is indicated by 33. Radius 30 can range from 3 to 6 mts (3 to 6 yds), depending on type and degree of formality of game play and age of players.

The preferred embodiment of a turnstile goal uses a sturdy metal rectangular grid frame structures as paddle elements, with size of elements varied to best suit type of game play. For football (soccer) and team handball, using fairly large diameter balls, paddle elements should be approximately square, or a little wider than high, and should have dimensions ranging from 2 to 3 times those of diameter of play ball. Paddle elements should be elevated high enough above base support and playing surface so that a rolling ball would not touch paddle elements. For lacrosse and ice hockey, paddle elements should be smaller in size and closer to playing surface as compared to above. All components of turnstile goal should have smooth and rounded corners and edges for player safety.

Use of turnstile goals in general reduces number of goals required for game play to only one, while at the same time, the game playing area can be reduced to one-third or one-fourth that required for conventional game play. Use of subject invention turnstile goal with relatively large paddle type elements permits vigorous team action play of games such as football (soccer), team handball, lacrosse, and ice hockey in a compressed playing area, while still permitting use of the normal skills, strategy, and teamwork associated with conventional games. Players can maneuver, pass, and shoot at their designated sides of turnstile paddles with ball or disc (puck) to register a gain in play. Shot at goal can be from a considerable distance since goal paddles are large. The general idea in shooting at goal is to hit proper paddle side with strongest possible force with ball or disc and make turnstile register maximum rotation. Ease of turnstile rotation can be controlled to suit game play. In typical turnstile football (soccer) game, players can number from four to ten per team. Limit circle around turnstile goal should have a radius of about 5 mts (5 yds). Playing rules are same as for conventional game but no game play is permitted inside limit circle, however, ball can be cleared with foot and returned to valid playing area outside limit circle. Game is started from assumed or marked spot about 5 mts (5 yds) back from limit circle by drop of ball between two competing players, with all other players back about 3 mts (3 yds) until ball is touched. Thereafter, game play is same as conventional play. At opportune moment, team player can shoot at his goal. If ball hits paddle and registers a gain, one important strategy is to have his teammates be positioned to recover rebounding ball since play is continuous. Minor game play fouls result in loss of ball possession or future loss of ball possession. Major or dangerous fouls result in a free penalty kick at turnstile from limit circle. Also, if a team player touches turnstile, position of turnstile must be restored, and opposing team is given a free penalty kick. Players can enter or cross limit circle area but can not remain in area for more than 3 seconds. No defense of any kind is permitted in limit circle. After each hit of ball on turnstile, referee or score-keeper should record or note rotations and fractions thereof to keep track of game play progress. Game should be played in two halves, with team paddle designations being reversed at half-time. At end of game, team with more paddle rotation in their direction is winner. Games of team handball, lacrosse, and ice hockey are played in a somewhat similar manner as described above.

The invention may be embodied in other specific forms without departing from the spirit or essential attributes thereof, and accordingly, references should be made to the attached claims, rather than to the foregoing description as indicating the scope of the invention.

I claim:

1. Improved turnstile goal and games usage wherein said goal comprises two to five identical readily mountable paddle type elements, a rotatable vertical paddle support sleeve means, a fixed vertical spindle and support column means, a turnstile base support means, a turnstile friction control means, and a turnstile fractional rotation indicating means, with said paddle type elements being attached in vertical positions at equal angular spacing around the peripheral surface of said paddle support sleeve means, said paddle support sleeve means being carried on said spindle and support column means, said spindle and support column means being attached to said base support means and holding assembled said goal in a secure and upright position, said goal being capable of rotation in a responsive direction when either side of any of its said paddle type elements is struck by a game ball or disc propelled by team players, said goal being characterised in that the said paddle type elements of said goal have substantially greater height and width measurements than those of the diameter measurements of the various balls and disc used, said height and width measurements of the said paddle type elements of said goal ranging from 9 to 36 inches (22.9 to 91.4 cms), each side of said paddle type elements of said goal having a specific type of distinguishing marking or designation indicating which side of said paddle type elements of said goal is to be struck by player propelled ball or disc for team play advantage, and said paddle support sleeve means being a pipe body with an elongated sleeve bushing inside of said paddle support sleeve means, with a screw and lug fastening arrangement employed for readily mounting said paddle type elements to said pipe body.

2. Improved turnstile goal and games usage wherein said goal comprises two to five identical readily mountable paddle type elements, a rotatable vertical paddle support sleeve means, a fixed vertical spindle and support column means, a turnstile base support means, a turnstile friction control means, and a turnstile fractional rotation indicating means, with said paddle type elements being attached in vertical positions at equal angular spacing around the peripheral surface of said paddle support sleeve means, said paddle support sleeve means being carried on said spindle and support column means, said spindle and support column means being attached to said base support means and holding assembled said goal in a secure and upright position, said goal being capable of rotation in a responsive direction when either side of any of its said paddle type elements is struck by a game ball or disc propelled by team players, said goal being characterised in that the said paddle type elements of said goal have substantially greater height and width measurements than those of the diameter measurements of the various balls or disc used, said height and width measurements of said paddle type elements of said goal ranging from 9 to 36 inches (22.9 to 91.4 cms), each side of said paddle type elements of said goal having a specific type of distinguishing marking or designation indicating which side of said paddle type elements of said goal is to be struck by player propelled ball or disc for team play advantage, and said spindle and support column means comprising an elongated metal rod threaded at upper end and centrally united at lower end to a metal pipe section, with juncture of said rod and said pipe section so formed to provide a smooth concentric bearing surface for carrying said paddle support sleeve means, with said metal rod threaded at upper end being used to receive a cap nut for securing said support sleeve means.

3. Improved turnstile goal and games usage according to claim 1 or 2, wherein said paddle type elements are rectangular grid structures with a screw and lug fastening arrangement employed for readily mounting said paddle type elements to said pipe body.

4. Improved turnstile goal and games usage according to claim 2, wherein said turnstile friction control means comprises a compressed spring and washer assembly between the fixed said cap nut on upper end of said metal rod and the rotatable said paddle support sleeve means, whereby degree of friction can be controlled by changes of said spring with varying stiffness and insertion of small washers around said rod end between said cap nut and said spring.

5. Improved turnstile goal and games usage according to claim 1 or 2, wherein said turnstile fractional rotation indicating means comprises graduated scale markings and numbers about the perimeter of fixed said turnstile base support means and an indicating pointer attached to outer lower side of one of rotable said paddle type elements.

* * * * *